US006527877B1

(12) United States Patent
Dorofeev

(10) Patent No.: US 6,527,877 B1
(45) Date of Patent: Mar. 4, 2003

(54) IRON-BASED ALLOY CONTAINING BONDED AND FREE CARBON AND METHOD OF MANUFACTURING THE SAME

(75) Inventor: Genrikh Alexeevich Dorofeev, Tula (RU)

(73) Assignee: Limited Liability Company "SKM", Tula (RU)

( * ) Notice: Subject to any disclaimer, the term of this patent is extended or adjusted under 35 U.S.C. 154(b) by 0 days.

(21) Appl. No.: 09/298,555

(22) Filed: Apr. 22, 1999

(30) Foreign Application Priority Data

Apr. 23, 1998 (RU) ..... 98107782

(51) Int. Cl.[7] ..... C22C 38/00; C22C 37/00

(52) U.S. Cl. ..... 148/320; 148/321; 148/319; 148/328; 75/517; 75/566; 75/574; 420/8; 420/9; 420/13; 420/39

(58) Field of Search ..... 420/8, 9, 13, 39; 148/129, 319, 320, 321, 328; 75/517, 566, 574

(56) References Cited

U.S. PATENT DOCUMENTS 4,396,440 A * 8/1983 Thome ..... 148/321
5,972,128 A * 10/1999 Miwa ..... 148/321

FOREIGN PATENT DOCUMENTS

| | | |
|---|---|---|
| EP | 0 751 232 A1 | 1/1997 |
| RU | 590365 | 2/1978 |
| RU | 2012652 | 5/1994 |
| RU | 2040574 | 7/1995 |

OTHER PUBLICATIONS

B. S. Mitin, Ph.D., Powder Metallurgy and Spraying Coating, Moscow, M etakkurgy, 1987, p. 301–302.

* cited by examiner

*Primary Examiner*—Deborah Yee

(74) *Attorney, Agent, or Firm*—Graybeal Jackson Haley LLP

(57) ABSTRACT

An alloy having two constituents: a crystal structure of orderly solid iron-based solution; a non-metallic phase at least partially soluble in iron including particles which are uniformly dispersed in the volume of the first phase and are of suitable size. In a preferred embodiment, the alloy contains iron with dissolved and bonded carbon as the first phase, which forms the crystal structure, and material partially soluble in iron, for example structurally free molecular carbon, is taken as the second non-metallic phase. The alloy preferably contains the components at the following ratios, % by mass: carbon in a dissolved and in a bonded state: 0.01–1.00; free carbon: 0.01–2.24; iron: balance. The ratio of free carbon to that of carbon in a dissolved and in a bonded state ranges from 0.01 to 20. The alloy Is preferably produced by melting out low carbon semi-product, overheating the semi-product above a liquidus temperature, for example by 20–70° C., carburizing the melt by introducing carbon black with particle sizes ranging from $10^{-5}$–$10^{-7}$ cm taken in an amount of 0.01–2.14% of melt mass, and deoxidizing by introducing elements the affinity of which for oxygen is equal and/or more than aluminium's affinity to oxygen taken in an amount of 0.05–3% of melt mass to provide an alloy with a ratio between free carbon and bonded carbon in the melt of 0.01–20.0. As an initial charge DRI (directly reduced iron) and/or pig iron can be used in a liquid and/or In a solid state in an amount of 75–100%. After finishing and casting the alloy may go through solidification and pressure treatment to create a final product.

7 Claims, No Drawings

IRON-BASED ALLOY CONTAINING BONDED AND FREE CARBON AND METHOD OF MANUFACTURING THE SAME

FIELD OF THE INVENTION

The present invention relates to metallurgy, and more specifically to iron-based alloys and methods of their manufacture. The present invention can be used to best advantage to produce structural elements or products, which meet higher than usual demands on strength and plasticity.

PRIOR ART

There is known an effect of carbon on properties of iron-based alloys. Its presence in metal in the form of iron carbide improves strength of steel but simultaneously deteriorates its plasticity. Such contradictory effect prevents one from obtaining an optimal combination of these properties and requires the use of thermal treatment or addition of alloying elements.

In modern technology there are known and widely used iron-based materials containing two phases: the first phase is a crystal structure of solid iron-based solution and the second phase is a non-metallic phase partially soluble in iron. Different elements such as carbon, nitrogen, sulfur, oxygen, etc. are used as said non-metallic phase, but carbon is more widespread. Examples of such materials include DRI (directly pro-reduced iron), soot iron, metallized pellets or briquettes containing free carbon and carbon partially bonded with iron, which are a simple mechanical blend of free carbon and Iron-carbon alloy. However, these materials strictly saying, cannot be alloys and have a large amount of unavoidable residuals. As a result, they have no required deformability and cannot be used as structural materials.

There are known iron-carbon alloys containing a non-metallic phase in the form of carbon, e.g., iron graphite and so called graphitized steels. Iron graphite contains a metallic base-iron-carbon alloy and 0.5–7.0% of structurally free carbon in the form of graphite ("Powder Metallurgy and Spraying Coatings", Moscow Metallurgy, 1987, p.301–302). Unlike graphitized steels, iron graphite in addition to iron-bonded carbon contains kish, a steelmaking by product. The latter is partially a source of carbon for carburization of the initial metallic matrix and residual graphite can serve as a lubricant under conditions of friction. The main field of its use is anti-friction items.

Recently,efforts have been made to use graphitized steels as structural materials in machinery. Such steels are produced by means of annealing, which provides the transition of iron-bonded carbon to a free state and formation of graphite, a product of complete or partial decomposition of iron carbide. Therefore, in these steels, carbon is present in both a bonded and free state.

However, carbon existing in such steels is a temper graphite, i.e., a secondary carbon formed in a solid state as a result of phase changes of iron carbide. Such carbon existing in the form of dispersed particles improves cold forgeability and cuttability of steel. However, a great difference in size of graphite particles and their non-uniform distribution in the volume of metal results from different rates of diffusion and activity of particles. This diversity often prevents these products from attaining the required strength and hardness of steel. As a result, graphitized steel has nonuniform macro and microstructure, which deteriorates its mechanical and operating properties. That is why graphitized steels are not so widely used.

In the prior art, a steel material is known containing a phase that forms crystal structure of solid iron-based solution and a structurally free non-metallic phase in the form of a secondary carbon, which has a mean grain diameter of not more than 4.0 $\mu$m and a grain density of at least 3,000 pcs/mm$^2$. This steel comprises by weight 0.30 to 1.0% of C, 0.4 to 1.3% of Si, 0.3 to 1.0% of Mn, 0.0003 to 0.006% of B, 0.002 to 0.010% of N and 0.05 to 0.20% of Mo, with the balance being iron and unavoidable residuals( A1, EP 0751232, 02.01.97).

The mechanical properties and the grain structure of this prior art steel material was improved by the addition of Mo. Owing to the specific composition of the steel material and method for its making, all carbon in this prior art steel is present in the form of a temper graphite, i.e., it was formed on the completion of a production process and would not act as nuclei on solidification because the oxide and nitride non-metallic inclusions retained their iron nucleating properties, thus preventing the possibility of carbon atom replacement for nucleation.

Graphite particles In this prior art steel material have a wide range of grain diameters, the size of which could be more or less than the size of a critical nucleating particle. Moreover, the share of particles that could act as nucleating centers was not controlled. Under such conditions, it was and is difficult to provide consistent metal composition and high quality.

Temper graphite of the type present in the prior art steel is characterized with a strong interatomic bond In the matrix lattice, lowered activity and relatively low rate of dissolution in Iron. The result of its use is a delayed dissolution of carbon in iron during thermal treating, non-uniform hardening and microfissures during formation, and a change for the worse of the properties of the alloy and products from it (strength, hardness, etc.).

The presence of carbon only in a free state in the prior art steel does not allow for combining strength and plasticity, requires hardening in a cold state, and limits the upper available level of carbon by the magnitude of carbon concentration.

An obligatory presence of Mo in the prior art steel providing the required conditions to form fine graphite and Rs uniform dispersion Involves difficulties in technological operation and large financial expenditures.

SUMMARY OF THE INVENTION

According to this invention, we provide an Inexpensive iron-carbon alloy for use in the production of structural elements and products, which is characterized by high strength and plasticity and good cold workability on behalf of two states of carbon present in the alloy namely, a free and a bonded and/or dissolved carbon, and more complete use of free carbon to act as nuclei for crystallization during solidification of the alloy. Said alloy comprises a constituent forming a crystal structure of a solid iron-based solution comprising a structurally free phase forming non-metallic constituent, which particle size is equal to and/or exceeds a size of a critical nuclei and which is uniformly dispersed in the volume of the constituent forming a crystal structure.

The constituent forming a crystal structure comprises iron with dissolved and bonded carbon, and the phase-forming non-metallic constituent comprises the structurally free molecular carbon in the form of carbon black.

In a preferred embodiment, particle size of carbon black is $10^{-5}$–$10^{-7}$ cm; the ratio between carbon in a free state, and carbon in a bonded and in a dissolved state is from 0.01 to 20.0; the constituent forming a crystal structure contains at least of one element having an affinity for carbon greater than or equal to that of iron.

The present invention further provides a method of manufacturing said alloy comprising melting out low carbon semiproduct using directly pro-reduced Iron (DRI) and/or pig iron as a charge material of which an amount of 75–100% is loaded into a melting vessel in a liquid and/or a solid state to form a melt. Said melt is overheated by 20–70° C. above a liquidus temperature, and carburized with carbon black having particle sizes of about $10^{-5}$–$10^{-7}$ cm, which can be introduced in an amount of 0.01–2.14% of the melt mass at tapping and/or at finishing and/or when casting. In so doing, the melt product produced is deoxidized with elements having an affinity for oxygen equal to or greater than aluminum's affinity for oxygen; these deoxidizers are taken in an amount of 0.05–3% of the melt mass to provide a desired ratio between carbon in a free state, and in a dissolved and in a bonded state as 0.01–20.0. The method preferably includes solidification of the melt obtained and casting pressure treatment. Carbon for carburization is introduced into a ladle and/or into a tundish and/or into a moulding box in the form of a sooty iron. Low carbon semiproduct can be produced by oxidizing, remelting or fluidized-bed processes.

Comparison of the present invention with the prior art demonstrates that the invention is new and inventive; the claimed alloy is characterized by a definite composition ratio between components and their physical state, i.e., the presence of free carbon with particle size of $10^{-5}$–$10^{-7}$ cm and free carbon to the iron-bonded carbon ratio as 0.01–20.0.

As stated previously, iron-based alloys containing dissolved carbon and carbon in the free state are known. However, the presence of structurally free carbon in a molecular form with mean particle size of $10^{-5}$–$10^{-7}$ cm taken in a definite ratio between dissolved carbon and iron-bonded carbon and a definite ratio between all components of the alloy is believed to define a non-obvious improvement over the prior art.

One of the technical advantages of the present invention is the introduction of nuclei of crystallization into liquid metal in a form of carbon black to simultaneously exclude ordinary refractory non-metallic inclusions, minimize physical and chemical non-uniformity in cast metal, and impart the Initial cast material with maximum plasticity and minimum strength before subsequent deformation.

Another technical advantage of the invention is to create a reserve of free carbon in liquid metal and a simultaneous decrease of dissolved carbon, conserve carbon in a free state from the moment of liquid metal melting up to the completion of deformation, and strengthen the alloy produced without a deterioration of its plasticity after post formation manipulation.

One more technical advantage relates to the ability to control free carbon content in the alloy in a solid state and to manufacture different materials with the desired chemistry and carbon content from one and the same Initial material.

Still another technical advantage is the improvement of plasticity with strength of the material or products obtained from it, reduction in costs due to the elimination of expensive and low efficiency thermal treatment process, and use of deficit alloying elements.

DETAILED DESCRIPTION OF THE INVENTION

Structurally free molecular carbon is introduced into said alloy within the above mentioned range and within the stated range of particle size diameters in order to establish a colloidal solution containing particles of free carbon as a dispersed phase and a separate independent solid phase. This colloidal solution provides a definite level of stability and at the same time an ability for carbon to transition from a free state to a dissolved state, both in a liquid and in a solid state.

The colloidal solution obtained conserves the initial state of carbon existence during the whole period of the liquid and the solid metal phase existence providing carbon phase transition, variations of strength and plasticity in a wide range in finished products or at the preceding stages.

Particles of carbon having an amorphous structure and high melting temperature of about 3700° C. are characterized by low rate of dissolution in liquid steel, especially at temperatures only slightly above the steel's liquidus temperature. Therefore, the colloidal system "steel-carbon", being in a non-equilibrium state, is stable enough so that the equilibrium can be attained very slowly. The increased dispersion of carbon particles ($10^{-5}$–$10^{-7}$ cm) further increases the kinetic stability of the given colloidal solution.

Carbon particle size in a molecular shape is much larger than the size of separate molecules, atoms or ions of carbon. Due to the rate of carbon inclusions, diffusion is much less than the migration rate of elementary carbon particles containing carbon that results in improved stability of colloidal solution of carbon in steel. Increased viscosity of iron due to the presence of colloidal carbon particles gives an additional positive effect.

Moreover, surfactants present in the melt (P, S, H, N, O, etc.) create a protective layer around colloidal particles, thereby preventing these particles from quickly disassociating in iron or mutually consolidating.

The factors mentioned above, together with minimum overheating of liquid steel, provide a definite stability of a colloidal solution both in a liquid and in a solid state, thereby retaining the ability of said colloidal solution to transform into true solution of carbon in iron.

The colloidal solution of the invention has a specific nature that allows transformation of a part or the entire free carbon into a dissolved state under definite conditions, including solid steel. The latter case is of a great importance and allows a change in the ratio between free carbon and iron-bonded carbon both during initial liquid steel production and during deformation of metal obtained or even in the finished product. Therefore, it becomes possible to control relative amount of iron carbide in steel at any stage of its production and subsequent deformation.

Adjusting the degree of carbon transformation from a free molecular state into a bonded state with metal matrix makes it possible to produce steels with different contents of dissolved carbon in a solid state and with different levels of hardening without having to remelt the alloy and Introduce an additional amount of carbon or alloying elements, or engage in thermal treatment.

The presence of free carbon in a molecular state prevents from the formation of large inclusions of iron carbide, which impair properties of steel when carbon content is higher than 1%. Owing to this and availability to transform free carbon to a bonded state, it is possible to increase carbon content in steel up to a limiting value of about 2.14%, and to widen the assortment of carbon steels that can be used as a structural material.

The amount of free carbon is specified by the desired carbon content in steel, and the total content of dissolved and free carbon must correspond to their content in finished material. In this case, the total amount of free carbon should be transformed into a dissolved state. However, this steel can contain an increased amount of free carbon when total content of free and iron-bonded carbon exceeds its upper limit in finished steel. Under such circumstances, the excess of free carbon can be easily removed from steel under definite conditions during its deformation or after manufacture of a final product. In this case, residual free carbon, due to its fine dispersion, does not have any negative impact on mechanical properties of metal. In some other cases, the excess of free carbon is desirable, for example for steels working under conditions of friction. Free carbon also enhances damping characteristics of steel, and provides its reliable operation under dynamic loading. Due to this, total contents of free and iron-bonded carbon in steel can exceed preset carbon content in finished metal. For example, it was demonstrated during study that maintenance of definite conditions, namely, charge composition, temperature, tap-to-tap time, etc. allows production of carbon steel in which free carbon is not dissolved in the metallic matrix and does not transit into a solution, but is maintained in a molecular shape throughout the production cycle of steel and production of finished items.

Carbon black was selected as free carbon due to its fine dispersion, amorphous structure and high stability at the same time, which makes its graphitization difficult and provides conservation of its initial structure at steel melting temperatures, i.e., 1500–1600° C. Production of carbon black is mastered in an industrial scale; the cost of its production will be not high. Carbon black particle size $10^{-5}$–$10^{-7}$ cm was chosen from trial data. If free carbon particle size is less than $10^{-7}$, their partial dissolution in liquid metal occurs and increased share of dissolved carbon is observed that results in lowered efficiency of free carbon use.

If free carbon particle size Is more than $10^{-5}$ cm a part of such particles is not seized by solidified metal and may remain in the form of separate inclusions on grain boundaries. This results in decreased plasticity and makes the process of subsequent deformation difficult.

The content of iron-bonded carbon in the range of 0.01–1% is defined by the following reasons. When its content is more than 1%, metallic matrix softening and lowering of its strength occurs. Iron-bonded carbon less than 0.01% is not expedient and affects the efficiency of this material production.

Content of free carbon in the alloy is preferably between 0.01–2.14%. The upper value corresponds to a maximum content of dissolved carbon in iron (according to the diagram Fe—C) and corresponds to an iron-carbon alloy. Further, increasing free carbon content is not expedient due to the structural changes in steel and transition of free carbon into liquid iron. The lower value relates to special low-carbon steel containing less than 0.10% of dissolved carbon when strengthening effect connected with free carbon transition into a bonded state makes itself evident.

It is believed necessary to maintain the ratio between free carbon and iron-bonded carbon in the range of 0.01–20.0. If this ratio is less than 0.01, the effect of free carbon transition into a bonded state and strengthening resulting from that metallic matrix would be Insignificant. If this ratio is more than 20.0, the effect of carbon dissolved in the matrix became quite inconsiderable compared to carbon transformed from a free state into a bonded state, which makes it difficult to vary properties of the materials. That is why the free carbon to iron-bonded carbon ratio in the range of 0.01–20.0 is optimal.

The presence of, at least, one element having an affinity equal to or greater than iron's affinity for carbon, permits convenient adjustment of the composition of carbides and produce the desired level of hardness, ensuring the required mechanical properties. This is of a great importance for the materials with lowered carbon content, for example, automobile sheets. It is also allows one to control the level of matrix plasticity due to the increased iron carbide content relatively to the total content of iron as well as the relationship between iron and additional elements in steel.

The given limited characteristics during melting will be explained as follows. If the amount of DRI and/or pig iron in the charge is less than 75%, then the remaining charge has to be replaced with more "dirty" scrap. Scrap, not being a virgin material, introduces into steel dispersed refractory inclusions, which are difficult to remove from the melt. Moreover, these inclusions become the nuclei of crystallization, replacing the desired ultra-fine particles of free carbon.

The upper limit of a virgin material (100%) in the charge is connected with complete use of all advantages of carbon alloy and a method of making the same to attain maximum available properties of finished products.

The level of the melt overheating above a liquidus temperature should be in the range of 20–70° C. This limit provides the required intensity of diffusion in the melt, the oxidation rate of the dissolved carbon and conservation of stability of the colloidal solution. At higher overheating, carbon oxidation is intensified but in this case a part of colloidal particles of carbon in the melt loose their stability and transits into iron solution decreasing the share of free carbon. If melt overheating is less than 20° C., the stability of colloidal solution is increased but in this case the rate of the dissolved carbon oxidation Is decreased changing for the worse the uniformity of blending colloidal particles of carbon and liquid iron. Overheating in the limits of 20–70° C. provides conservation of the liquid melt structure approximately corresponding to the structure of the solid state that results in the decreased rate of carbon particles dissolution and the increased stability of colloidal carbon solution in iron.

Deoxidation by elements having the affinity for oxygen equal or more than aluminum's affinity for oxygen prevents from formation of dispersed inclusions of aluminum oxides and nitrites and eliminates their effect on the process of crystallization, structure and properties of finished products. In this case, particles of the dispersed carbon serve as nuclei of crystallization and products of oxidation of such elements as calcium barium, manganese, lithium strontium (Ca, Ba, Mn, Zi, Sr) and rare-earth elements less impure steel due to their low dissolution in iron and can be easily removed from the melt.

EXAMPLE

There was produced an alloy chemical composition of which is given In Table 1.

TABLE 1

CHEMICAL COMPOSITION OF THE ALLOY

| | Elements, % mass | | | | | | |
|---|---|---|---|---|---|---|---|
| Heat | $C_{free}$ | $C_{combined}$ | Ratio between $C_1$ and $C_c$ | Si | Mn | P | S |
| 1 | 1.600 | 0.08 | 20 | 0.70 | 0.30 | 0.027 | 0.023 |
| 2 | 1.59 | 0.09 | 17.7 | 0.75 | 0.32 | 0.029 | 0.025 |

Directly pro-reduced iron and pig iron were used as the initial charge, thereby decreasing or event preventing the Introduction of refractory oxides, nitrides, and carbide impurities into the melt These impurities improperly serve as alternative nuclei of crystallization as opposed to the carbon black, and are difficult to remove due to their fine dispersion and other factors.

The heat was carried out by overheating the alloy metal by 20–70° C. above a liquidus temperature in order to conserve the structure of the iron melt similar to its structure in the solid state. Due to this the rate of carbon dissolution and the level of Its transit into the true solution was decreased that resulted in an increased life of colloidal carbon particles in the melt and the decreased content of atomic carbon. Oxygen, nitrogen and hydrogen solubility in liquid iron was lowered as well as the contamination of liquid iron with non-metallic inclusions. Technical carbon black was used as carbon-containing material with particle size of $10^{-5}$–$10^{-7}$ cm. These particles became the nuclei of crystallization and replaced in this function non-metallic inclusions, improving quality of steel and providing the colloidal nature of carbon solution in liquid Iron. Colloidal solution of carbon had a definite degree of stability and allowed to conserve carbon in a free state from the moment of its introduction into the melt to the final deformation of the alloy obtained. Preventing from the formation of iron carbides it ensured in this case minimum strength and maximum plasticity of the metallic matrix during deformation and stamping.

Carbon black particles were introduced into a ladle, but they may be introduced Into a tundish or a mold in order to shorten their presence in the melt and to obtain constant content of a free carbon in liquid iron providing minimum transit of colloidal carbon into true solution with iron. Uniform blending of iron and carbon particles is available by an intensive mixing liquid alloy during its pouring (into a moulding box) or casting to obtain colloidal solution of carbon in iron at the later stages of the technological process.

After cementation of free carbon into a bonded state (iron carbide), the material obtained had strength and plasticity given in Table 2.

TABLE 2

MECHANICAL PROPERTIES OF THE ALLOY IN A NORMALIZED STATE AND PRODUCTS MADE OF IT

| Heat | Fatigue Strength, Z, kg/mm$^2$ | Specific Elongation g, % |
|---|---|---|
| 1 | 98 | 20 |
| 2 | 101 | 22 |
| Prior art | 85 | 6 |

As it can be seen from the data the claimed material essentially excels the known materials in the prior art in strength and plasticity.

INDUSTRIAL APPLICABILITY.

The present invention can be used to best advantage to produce structural elements and items which meet higher than usual demands on strength and plasticity.

What we claim is:

1. An iron alloy for use in the production of structural elements and products comprising:

a first constituent that forms a crystal structure in a solid iron-based solution comprising carbon in a dissolved and bonded state in an amount substantially 0.01–1.00% by weight relative to the weight of the alloy;

a second constituent having phase forming non-metallic properties comprising a, structurally free carbon material in an amount substantially 0.01–2.14% by weight relative to the weight of the alloy and with particle sizes about $10^{-5}$ to $10^{-7}$ cm; and wherein the ratio between carbon in a free state, and carbon in a dissolved and bonded state ranges from about 0.01 to 20 and wherein the second constituent is uniformly dispersed in a volume of the first constituent.

2. The alloy according to claim 1 wherein the structurally free carbon material comprises carbon black.

3. A method for making an iron-based alloy comprising carbon in a free state and in a bonded state for use in production of structural elements and products, the method comprising:

melting out a low carbon semiproduct from an initial iron charge;

overheating the semiproduct melt by approximately 20–70° C. above a liquidus temperature for the semiproduct melt;

carburizing the semiproduct melt with carbon black having particle sizes of about $10^{-5}$ to $10^{-7}$ cm; and deoxidizing the semiproduct melt to establish a ratio of about 0.01–20.0 between carbon in a free state, and carbon in a bonded and in a dissolved state.

4. The method according to claim 3 wherein carbon black is introduced in a weight amount of about 0.01–2.14% of the melt mass.

5. The method according to claim 4 wherein the carbon black is introduced into a vessel selected from the group consisting of a ladle, a tundish, and a molding box.

6. The method according to claim 3 wherein deoxidizing of the semiproduct melt is accomplished by introducing at least one element into the melt the affinity of which for oxygen is greater than or equal to aluminum's affinity for oxygen, taken in an amount of 0.05–3% of melt mass.

7. The method according to claim 3 wherein carbon black, in the form of soot iron, is introduced into a vessel selected from the group consisting of a ladle, a tundish, and a molding box in a weight amount of about 0.01–2.14% of the melt mass, and wherein deoxidizing of the semiproduct melt is accomplished by introducing at least one element into the melt the affinity of which for oxygen is greater than or equal to aluminum's affinity for oxygen, taken in an amount of 0.05–3% of melt mass.

* * * * *